US009765492B2

(12) United States Patent
Beaird, III

(10) Patent No.: US 9,765,492 B2
(45) Date of Patent: Sep. 19, 2017

(54) SNOWPLOW APPARATUS FOR A MOTOR VEHICLE

(71) Applicant: Robert L. Beaird, III, Pawling, NY (US)

(72) Inventor: Robert L. Beaird, III, Pawling, NY (US)

( * ) Notice: Subject to any disclaimer, the term of this patent is extended or adjusted under 35 U.S.C. 154(b) by 220 days.

(21) Appl. No.: 14/697,772

(22) Filed: Apr. 28, 2015

(65) Prior Publication Data

US 2015/0308060 A1 Oct. 29, 2015

Related U.S. Application Data

(60) Provisional application No. 61/984,993, filed on Apr. 28, 2014.

(51) Int. Cl.
*E01H 5/06* (2006.01)

(52) U.S. Cl.
CPC ..... *E01H 5/065* (2013.01); *E01H 5/061* (2013.01)

(58) Field of Classification Search
CPC E01H 5/06; E01H 5/066; E01H 5/063; E01H 5/061; E01H 5/065; E02F 3/7613; E02F 3/7618; E02F 3/7627; E02F 3/7631; E02F 3/3677; E02F 3/764; E02F 3/7645; E02F 3/765; E02F 3/7654
See application file for complete search history.

(56) References Cited

U.S. PATENT DOCUMENTS 1,977,817 A * 10/1934 Bird ..... E02F 3/7613 172/816
2,749,630 A * 6/1956 Nave ..... E02F 3/7613 172/821
2,950,550 A * 8/1960 French ..... E02F 3/7613 172/821
3,059,356 A * 10/1962 Lorang ..... E02F 3/7613 172/821
3,521,714 A * 7/1970 Farris ..... E02F 3/7613 172/821
3,529,678 A * 9/1970 Teasdale ..... E02F 3/7613 172/484
3,648,782 A * 3/1972 Mazzarins ..... E02F 3/7618 172/821

(Continued)

*Primary Examiner* — Jamie L McGowan
(74) *Attorney, Agent, or Firm* — Karl F. Milde, Jr.; Eckert Seamans Cherin & Merllott, LLC

(57) ABSTRACT

Snowplow apparatus comprises a connecting frame having a rearward mount with means for removable attachment to a motor vehicle at two spaced-apart points, and at least one forward mount with means for attachment to a snowplow. The connecting frame includes a first horizontal hinge adjacent the rearward mount and a second horizontal hinge adjacent the forward mount, a pivot axis of the first hinge and a pivot axis of the second hinge extending transverse to a central longitudinal axis of the vehicle. A snowplow, including at least one elongate snowplow blade, is attached to the connecting frame at the forward mount. A first powered mechanism raises and lowers the snowplow about the pivot axis of the first hinge and a second powered mechanism pivots the snowplow about the pivot axis of the second hinge, thereby adjusting the orientation of the snowplow blade with respect to the road when in the lowered operative position.

6 Claims, 12 Drawing Sheets

(56) References Cited

U.S. PATENT DOCUMENTS 3,653,451 A * 4/1972 Fryrear ..... E02F 3/7618 172/824
3,670,825 A * 6/1972 Asal ..... E02F 3/7627 172/663
3,773,116 A * 11/1973 Coontz ..... E02F 3/7613 172/817
3,822,751 A * 7/1974 Waterman ..... E02F 3/7631 172/821
3,991,832 A * 11/1976 Cooper ..... E02F 3/7613 172/812
4,013,132 A * 3/1977 Matsuzawa ..... E02F 3/8157 172/821
4,241,794 A * 12/1980 Halterman, Jr. ..... E02F 3/7613 172/818
4,249,323 A * 2/1981 Mathis ..... E01H 5/06 172/815
4,281,721 A * 8/1981 Beales ..... E02F 3/8157 172/821
4,364,439 A * 12/1982 Asal ..... E02F 3/7613 172/821
4,565,018 A * 1/1986 Oya ..... E01H 5/06 172/816
4,821,436 A * 4/1989 Slocum ..... E01H 5/063 172/811
4,824,319 A * 4/1989 Arnold ..... E02F 3/3613 403/338
4,848,483 A * 7/1989 Heiple ..... E02F 3/7609 172/821
5,403,144 A * 4/1995 Staben, Jr. ..... E02F 3/3677 172/272
5,447,204 A * 9/1995 Asal ..... E02F 3/80 172/821
5,713,418 A * 2/1998 Warren ..... E01C 19/38 172/40
5,778,567 A * 7/1998 Jager ..... E01H 5/06 172/272
6,035,944 A * 3/2000 Neuner ..... E02F 3/815 172/818
6,170,178 B1 * 1/2001 Christy ..... E01H 5/06 172/272
6,334,269 B1 * 1/2002 Dilks ..... E01H 5/06 172/63
6,526,677 B1 * 3/2003 Bloxdorf ..... E01H 5/066 37/231
6,594,923 B1 * 7/2003 Kost ..... E01H 5/06 37/231
7,171,769 B2 * 2/2007 Schultz ..... B60D 1/36 172/272
8,360,165 B2 * 1/2013 Leith ..... A01B 59/06 172/821
8,678,103 B2 * 3/2014 Miyuki ..... E02F 3/7627 172/813
8,875,419 B2 * 11/2014 Schmeichel ..... E01H 5/06 37/231
2009/0307941 A1 * 12/2009 Gamble, II ..... E01H 5/063 37/231
2011/0041366 A1 * 2/2011 Gappy ..... E01H 5/06 37/231
2011/0173847 A1 * 7/2011 Ropog ..... E01H 5/063 37/231

* cited by examiner

SNOWPLOW APPARATUS FOR A MOTOR VEHICLE

CROSS-REFERENCE TO RELATED APPLICATION

This application claims priority from U.S. Provisional Application No. 61/984,993, filed Apr. 28, 2014.

BACKGROUND OF THE INVENTION

The present invention relates to snowplow apparatus for mounting to a motor vehicle as an accessory. More particularly, the invention relates to snowplow apparatus that is adjustable about four different pivot points.

Snowplows are designed for ease of attachment to a truck or tractor during the fall and winter and removal during the spring summer. During operation they can be raised and lowered by the vehicle operator and, in the case of a hinged V-plow, the blades can be adjusted independently to form an "A" shape in front of the vehicle, a "V" shape for accumulating snow, and even to form a straight blade, either angled or perpendicular to the line of travel.

While snowplows can easily push snow, they are less than satisfactory when attempting to override snow with the blade and pull in backward, away from a building or door for example.

SUMMARY OF THE INVENTION

It is a principal object of the present invention to provide snowplow apparatus which can be attached as an accessory to the front of a motor vehicle and which allows the vehicle operator to adjust the position and angle of the snowplow blade over a wide range.

It is a further object of the present invention to provide snowplow apparatus, in particular a V-type snowplow, which is widely adjustable about four different pivot points for maximum flexibility.

These objects, as well as other objects which will become apparent from the discussion that follows are achieved, in accordance with the present invention, by providing snowplow apparatus which comprises:

(a) A connecting frame having a rearward mount with means for removable attachment to a motor vehicle at two spaced-apart points, and at least one forward mount with means for attachment to a snowplow. The connecting frame includes a first horizontal hinge adjacent the rearward mount and a second horizontal hinge adjacent said forward mount with the pivot axis of the first hinge and the pivot axis of the second hinge extending transverse to a central longitudinal axis of the vehicle.

(b) A snowplow, including at least one elongate snowplow blade, attached to the connecting frame at the forward mount thereof.

(c) A first powered mechanism for raising and lowering the snowplow about the pivot axis of the first hinge; and (d) A second powered mechanism for pivoting the snowplow about the pivot axis of the second hinge, thereby adjusting an angular orientation of the snowplow blade transverse to the central longitudinal axis of the vehicle.

The powered mechanisms employed with the present invention can be implemented as a winch, which powers cables or chains, but more preferably as a hydraulic system with an hydraulic pump, associated hydraulic fluid lines and control valves.

According to the invention the connecting frame preferably further includes a third horizontal hinge having a pivot axis substantially parallel to and in line with the central longitudinal axis of the vehicle. The snowplow blade pivots about the pivot axis of the third hinge, allowing it to tilt when a road is not planar. A resilient element is advantageously provided to bias the blade about this third pivot axis toward a substantially horizontal position.

Alternatively, a third powered mechanism may be provided for pivoting the snowplow blade about this axis, thereby to positively angle the blade with respect to the horizontal position.

According to a preferred embodiment of the invention, the third hinge comprises a "Pivot Box" which includes (a) first, second and third plates mounted together in succession in face-to-face relationship, the second and third plates each having a central circular opening with the opening in the second plate larger than the opening in the third plate, (b) a stepped cylindrical flange member rotatably mounted within, and substantially filling, the circular openings of said second and third plates, and (c) a rod member having one end mounted coaxially on the flange member and coupled to rotate therewith, and having an opposite end coupled to and supporting the snowplow blade.

In another preferred embodiment of the invention, the snowplow includes two elongate snowplow blades connected together, end to end, by means of a fourth hinge. A pivot axis of this fourth hinge extends substantially vertically and transverse to the central longitudinal axis of the vehicle so that the plow blades can form a "V" or an "A" shape. A fourth powered mechanism is provided for pivoting the two snowplow blades about this fourth pivot axis, either in synchronism or independently of each other.

According to a preferred embodiment of the invention, the fourth powered mechanism comprises a left hydraulic piston having two ends, one end being coupled exert force against the vehicle and an opposite end being coupled to exert force against the left blade, and a right hydraulic piston having two ends, one end being coupled exert force against the vehicle and an opposite end being coupled to exert force against the right blade.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
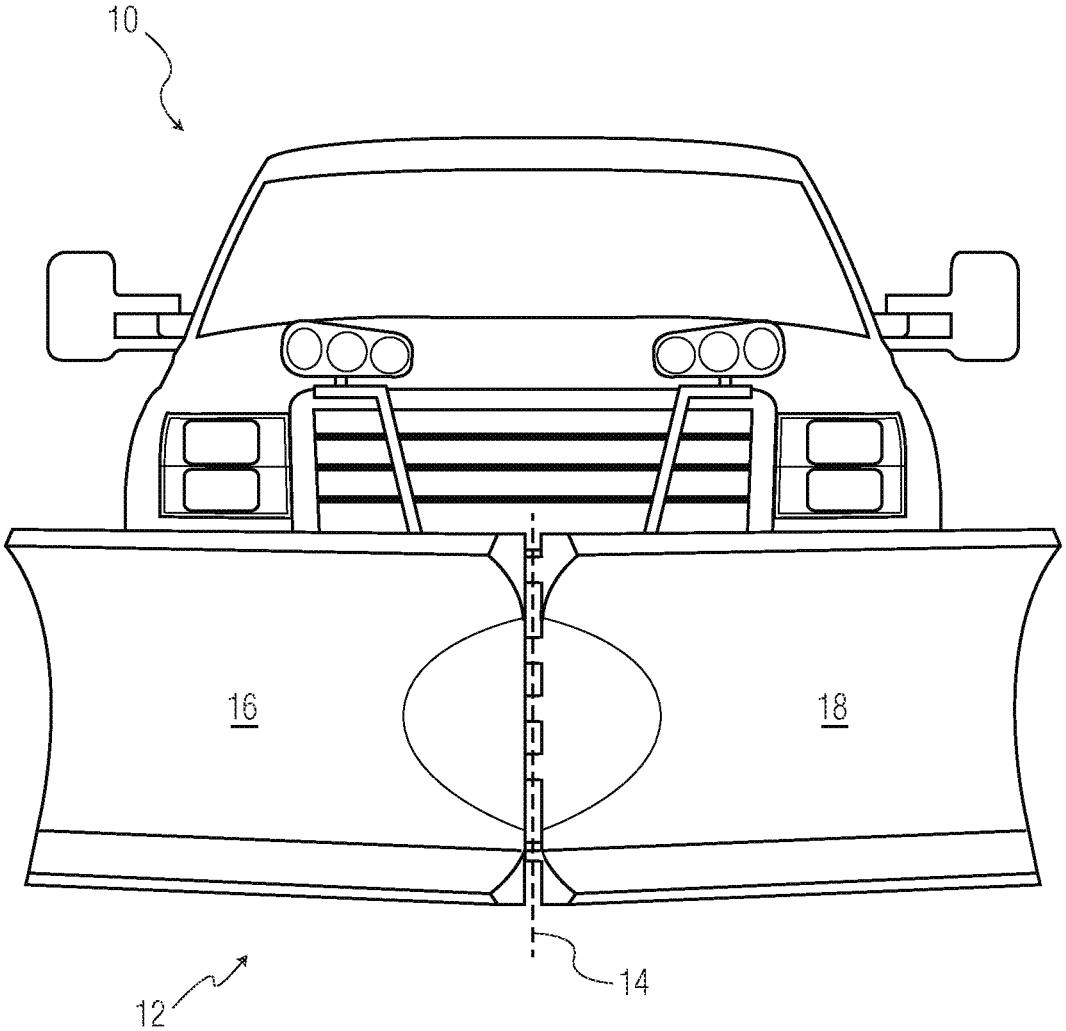
FIG. 1 PRIOR ART
FIG. 1 is a front of a motor vehicle (in this instance, a Ford F-350 pickup truck) to which has been attached a V-type snowplow.

The preferred embodiments of the present invention will now be described with reference to FIGS. 1-11 of the drawings. Identical elements in the various figures are designated with the same reference numerals.

FIG. 1 shows a Ford F-350 pickup truck 10 with a V-type snowplow 12 mounted on the front in a typical installation as is known in the prior art. The V-plow 12 is pivoted about a vertical axis 14 in the middle to allow angular adjustment of the two plow sections or blades 16 and 18 on the right and left sides, respectively, of the V-Plow. The blades of the plow can assume various configurations, including that of a straight plow, perpendicular to central longitudinal axis of the truck or angled to the right or to the left, or that of a V-plow with the blades of the extending forward in a "V-shape" to collect the snow, or backward (the normal position) in a "A-shape," as shown, to push the snow outward on both sides of a forward-moving vehicle.

Figure 2:
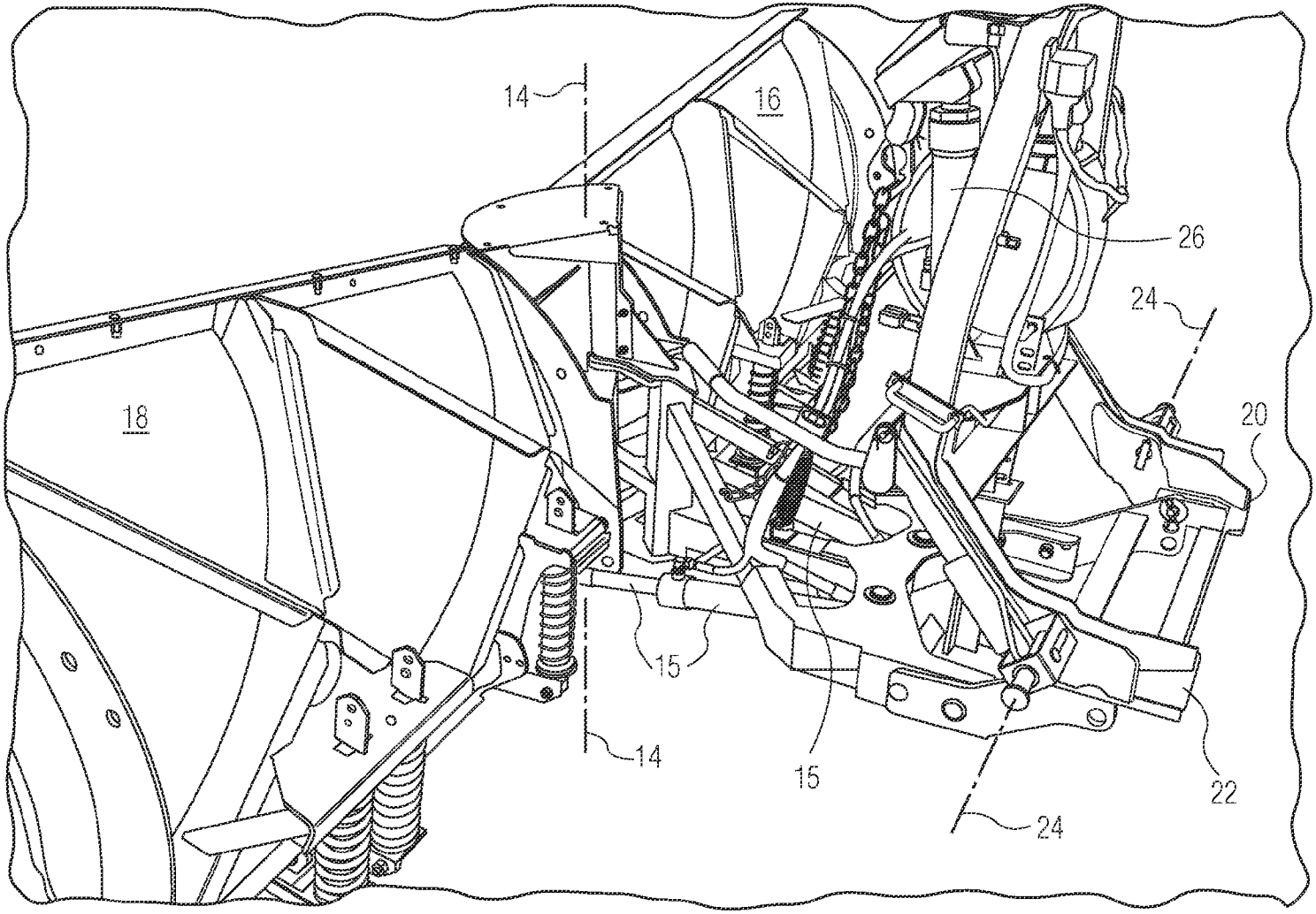
FIG. 2 PRIOR ART
FIG. 2 is a perspective view of a V-type snowplow as it is known in the prior art, showing the basic elements of the apparatus detached from the front of a vehicle.

FIG. 2 shows a prior art "V-plow" apparatus, detached from a vehicle. The parts of this apparatus are labeled with the same reference numbers as the corresponding parts shown in FIG. 1. Movement of the blades 16 and 18 about the vertical pivot axis 14 is effected by two hydraulic pistons 15, one for each blade. When attached to a vehicle by structural elements 20 and 22, the entire apparatus is raised and lowered about horizontal pivot axis 24 by a hydraulic piston 26.

Other than pivoting the blades about the vertical axis 14, the angles of the two blades 16 and 18 with respect to the road are not adjustable.

Figure 3:
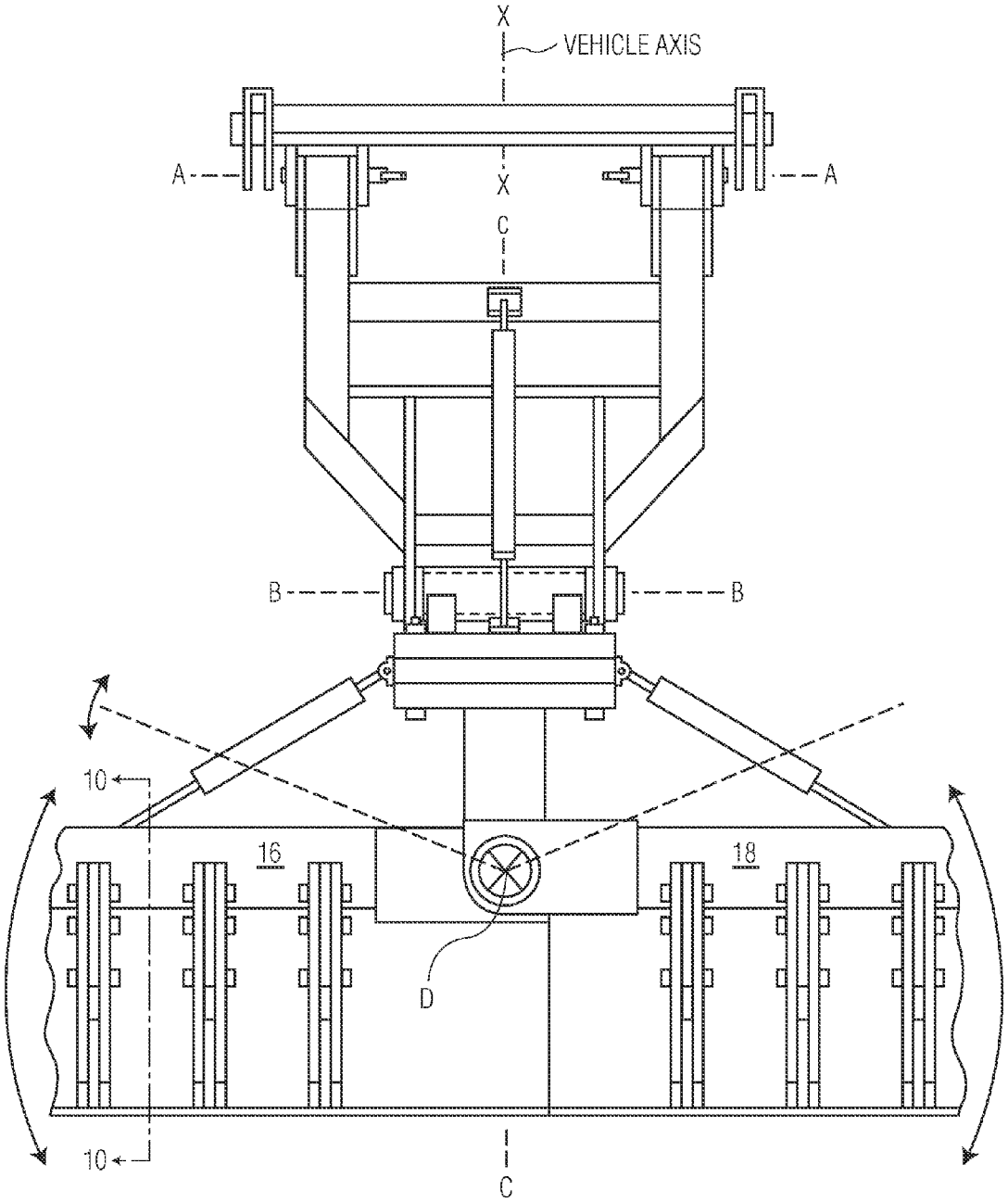
FIG. 3 is a representational diagram of snowplow apparatus according to the invention, seen in top view, indicating four pivot axes, A, B, C and D.

FIG. 3 illustrates the snowplow apparatus according to the present invention which allows angular movement about four separate pivot axes, A, B, C and D. Axes A and B are horizontal and perpendicular to the central longitudinal axis X of the vehicle to which the apparatus is attached. Pivot axis C is horizontal also, and is substantially in line with the vehicle axis X. Pivot axis D, which is the same as the vertical V-plow axis 14 in FIG. 1, is perpendicular to the three other axes A, B and C, and intersects axis C.

Figure 4:
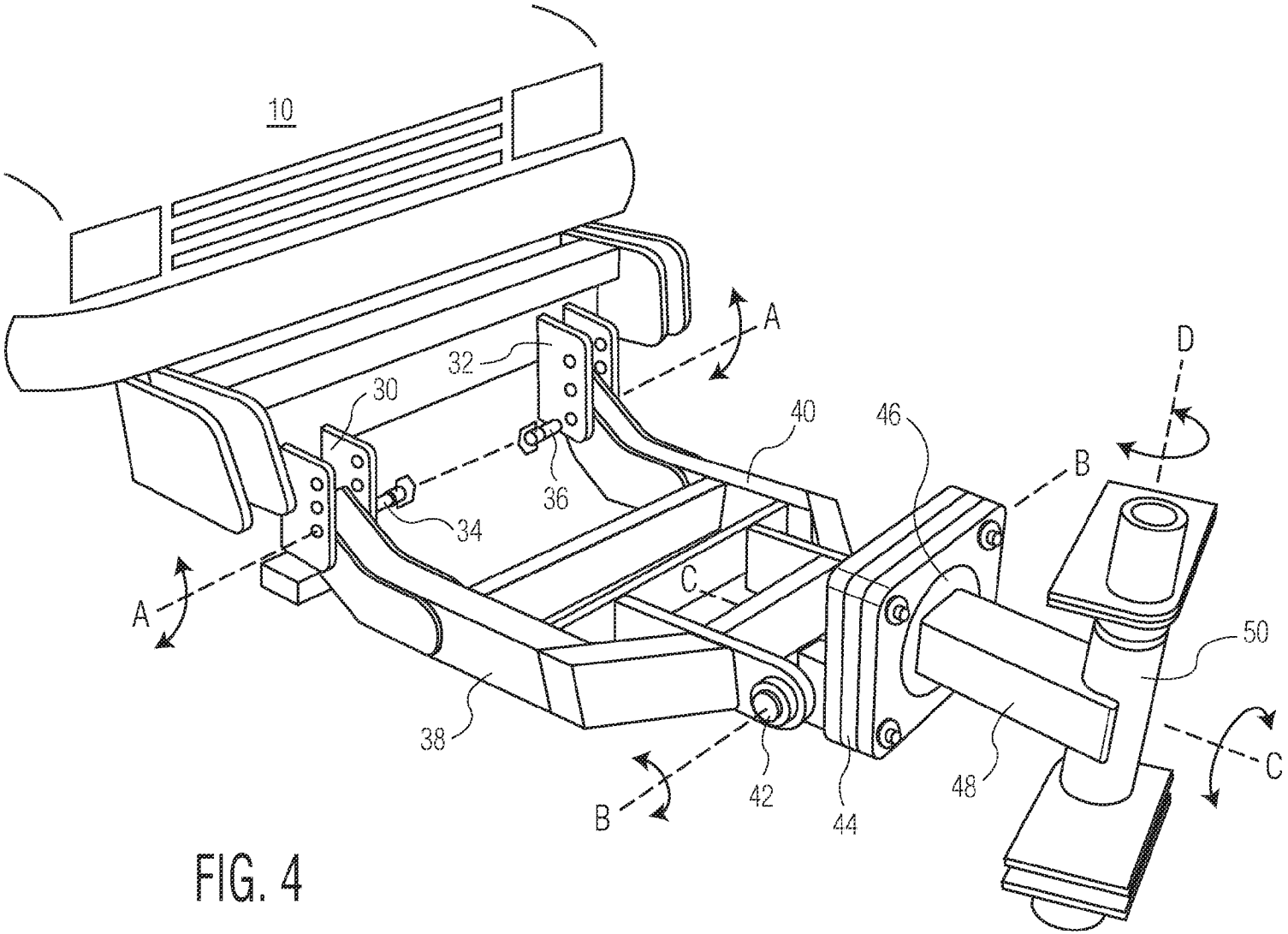
FIG. 4 is a perspective view of the snowplow apparatus according to the invention which incorporates the four pivot axes shown in FIG. 3.

A preferred embodiment of the present invention is shown in FIG. 4. The parts that pivot about the four axes A, B, C and D are readily seen. These parts include braces 30 and 32 that attach to the motor vehicle and, with pins 34 and 36, form a horizontal hinge at axis A about which the snowplow apparatus is raised and lowered.

Bars 38 and 40, which are pivoted on pins 34 and 36, respectively, extend forward to a second horizontal hinge 42 at axis B. A coupling or "Pivot Box" 44, including a rotatable flange 46 with a forward extending rod 48 that can rotate about the axis C, is mounted on the hinge 42 to permit sideways tilting of the snowplow blades in a manner explained below. The rotatable flange 46 is connected by the rod 48 to a vertically oriented bearing 50, thus forming a mechanism in the nature of a universal joint. The bearing 50 forms a hinge at axis D for the snowplow blades.

Figure 5:
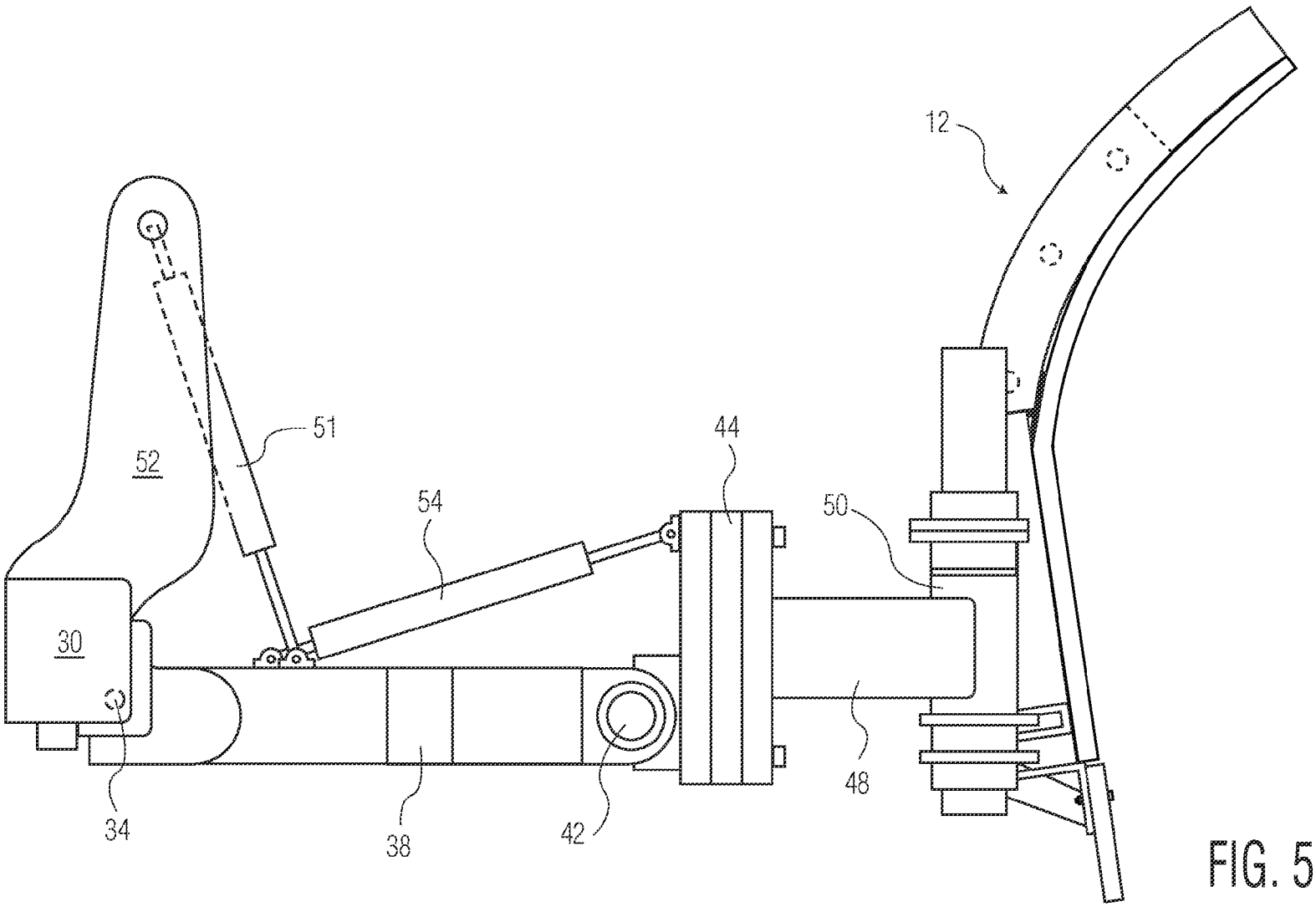
FIG. 5 is a side view of the snowplow apparatus according to the invention showing two of the hydraulic pistons used to operate the mechanism.

FIG. 5 shows two of the several hydraulic pistons used to operate the plow. Piston 51, mounted substantially vertically, is used to raise and lower the plow blades as well as to apply a downward pressure on the blades, if desired. Piston 51 is connected between an upright member 52 and the left-side plow frame 38.

Piston 54 is mounted substantially horizontally between the frame rails of the plow and the top of the Pivot Box 44 to control the pitch of the snowplow blades. Changing the pitch of the plow blades enables the operator to increase or decrease the aggressiveness of the plow while pushing snow. Pitching the plow forward while pulling snow backward makes for more effective back-blading.

Figure 6:
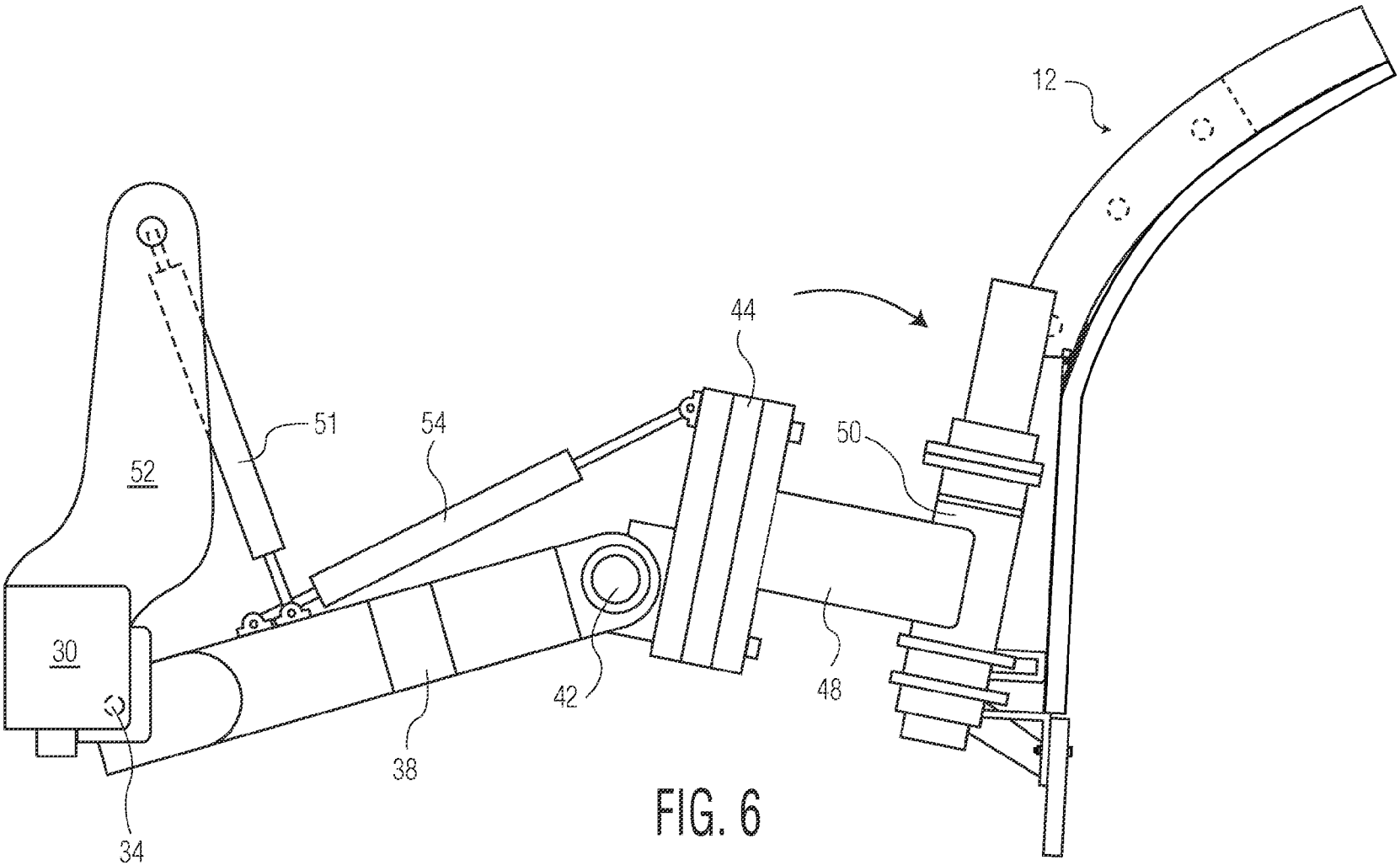
FIG. 6 is a side view of the snowplow apparatus of FIG. 5 illustrating the operation of mechanism.

The operation of the pistons 51 and 54 is illustrated in FIG. 6. Piston 51 is shown in the retracted position, in which the plow blades have been raised about the hinge 34. Piston 54 is shown in the extended position in which the blades are pitched forward about the hinge 42.

Figure 7:
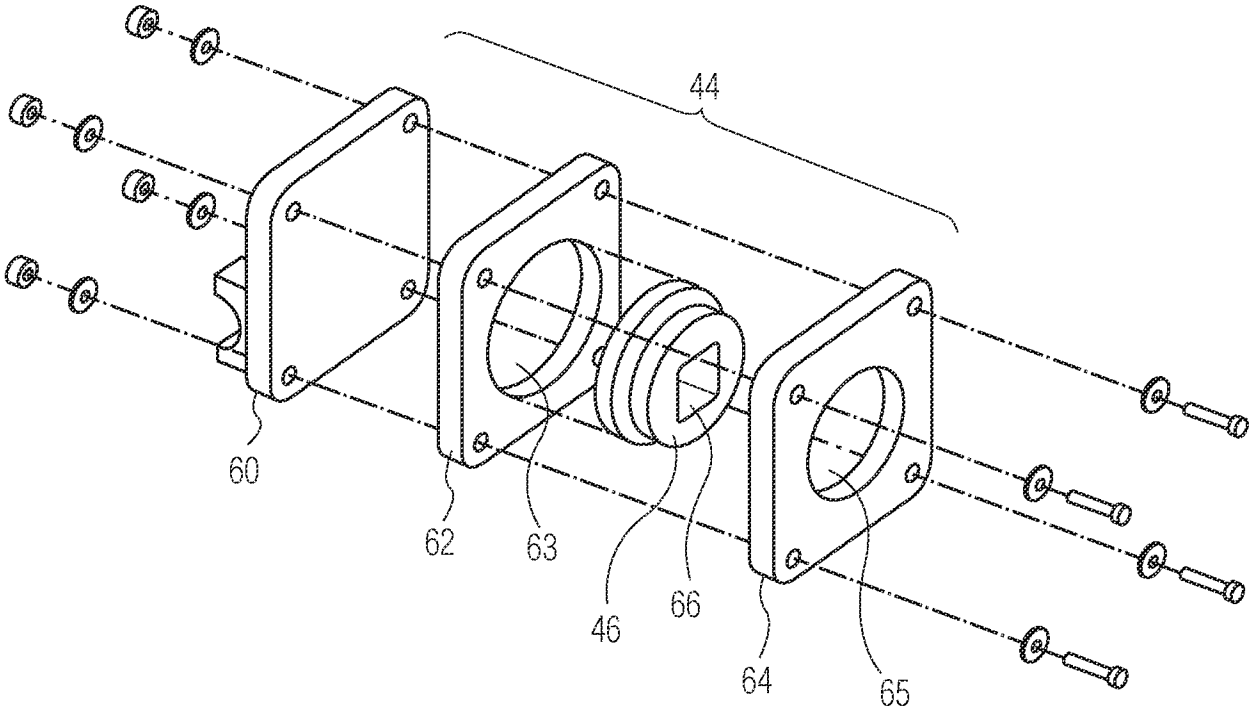
FIG. 7 is perspective, assembly diagram of the "Pivot Box" used in the snowplow apparatus according to the invention, showing the individual parts thereof.

Details of the Pivot Box 44 may be seen in FIG. 7. This device comprises three square plates 60, 62 and 64 bolted together at their corners to form a rectangular "box." Two plates 62 and 64 are provided with round openings 63 and 65, respectively, which accommodate a cylindrical member with a stepped profile that forms the aforementioned rotatable flange 46. Opening 65 in the plate 64 is smaller than the opening 63 in the plate 62 so as to retain the flange 46 while allowing rotation. A square central opening 66 is provided in the flange 46 to accommodate the rod 48 which has a square cross-section.

Figure 8:
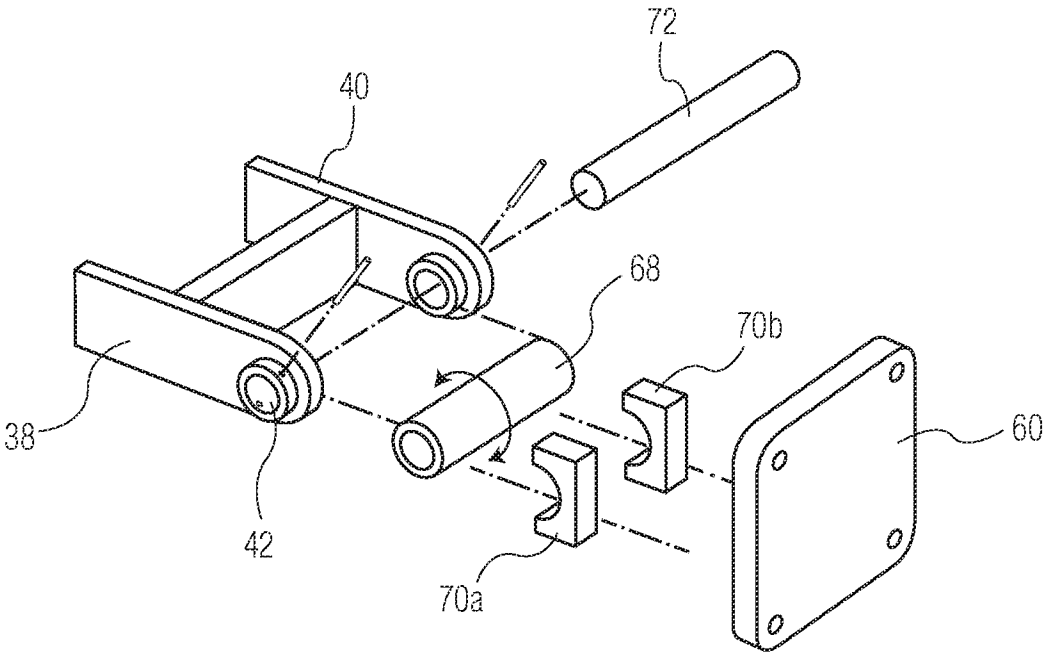
FIG. 8 is a perspective, assembly diagram of the forward horizontal hinge in the snowplow apparatus according to the invention, showing the individual parts thereof.

FIG. 8 shows details of the hinge 42 to which the Pivot Box 44 is connected. The rearward plate 60 of the Pivot Box is mounted on a hollow dowel 68 with intermediate members 70*a* and 70*b*, either by means of U-shaped clamps or by welding. The dowel 68, in turn, is retained in the hinge 42 by a pin 72.

Figure 9A:
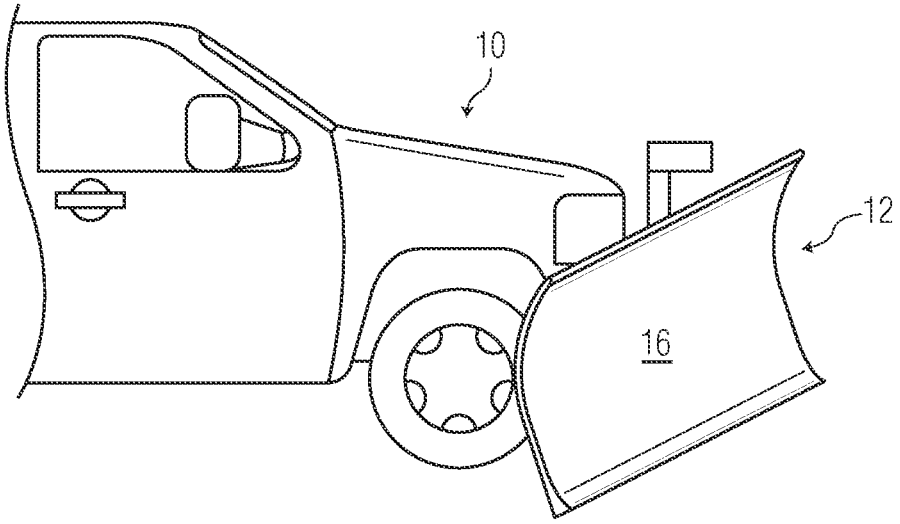
FIGS. 9A and 9B are side views of a motor vehicle with a snowplow in the lowered and raised positions, respectively.
Figure 9B:
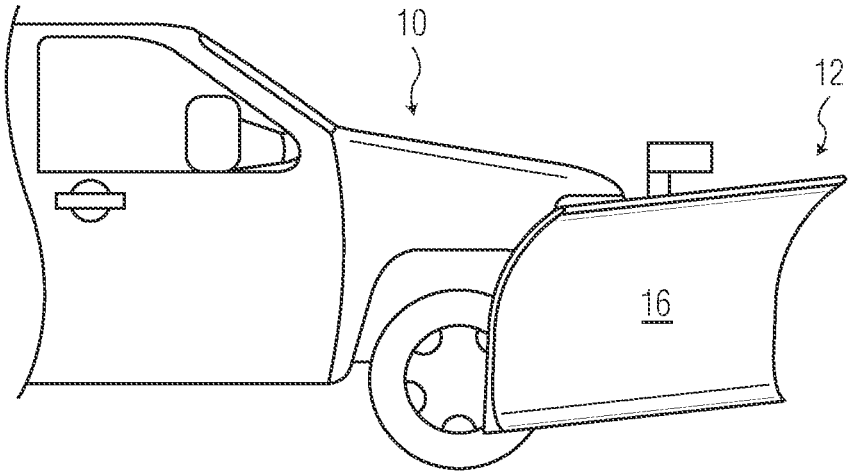

FIGS. 9A and 9B, respectively, show the snowplow apparatus in the lowered, plowing position and the raised, travel position as controlled by the piston 51 (FIGS. 5 and 6). As may be seen, the plow may be raised high above the road.

Figure 10:
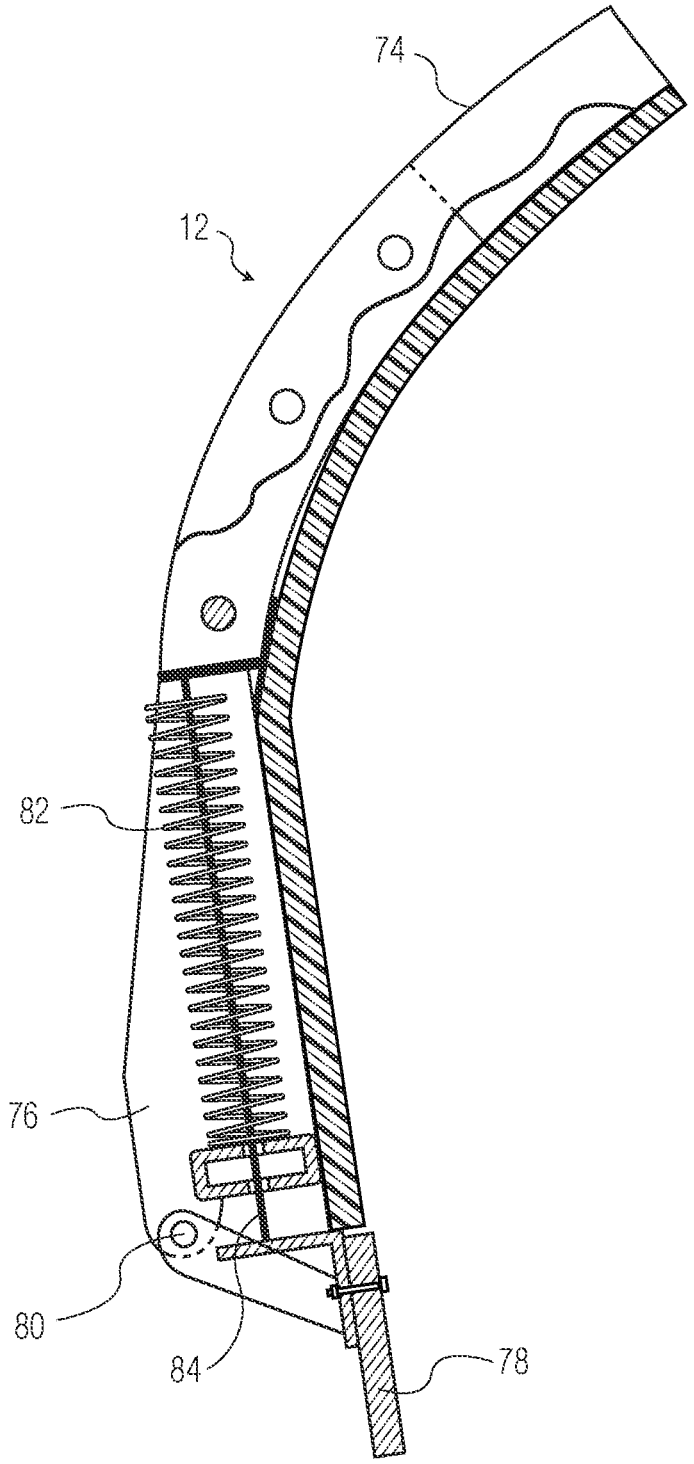
FIG. 10 is a representational diagram of the snowplow apparatus according to the invention, in side view, showing details of the top and bottom of one of the snowplow blades.

FIG. 10 illustrates a construction detail of the snowplow blade according to a preferred embodiment of the invention. The bottom fourteen inches, plus or minus, of the front surface of the blade features a flat contour. As explained above, the orientation of the blade with respect to the road is hydraulically adjustable. To cut into the snow at an optimal angle while pushing, for example, the blade is oriented the position shown in FIG. 5. Back-blading can be made more effective by tilting the blade forward in the manner shown in FIG. 6 when pulling the snow backward with the truck or tractor.

All of the strength is built into the bottom half of the plow, while the top half 74 is preferably made of a lighter material, such as aluminum. This aluminum part will gain its strength through its shape alone, which comprises a curled top that is bolted to the bottom part 76 in a modular fashion. Also illustrated is a trip blade mechanism which pivots the cutting edge 78 of the plow back about a hinge 80, pulling a coil spring 82 down from the front of the cutting edge by means of an adjustable connecting rod 84. The modular construction allows more strength and rigidity to be built into the plow where needed most, without adding extra weight where unnecessary. Furthermore, it allows the manufacturer to build the plow with moldboards of different shapes and sizes on the same platform. The pull instead of a push design of the trip edge suspension saves space by placing the springs in between the structural upright, rather than behind them. The connecting rod 84 that joins the top of the spring to the trip edge is much lighter in construction, compared to the structure needed to push a spring into collapse. This connecting rod 84 is also adjustable, allowing the trip edge to be adjusted for specific conditions or applications: residential, commercial, municipal, etc.

Figure 11A:
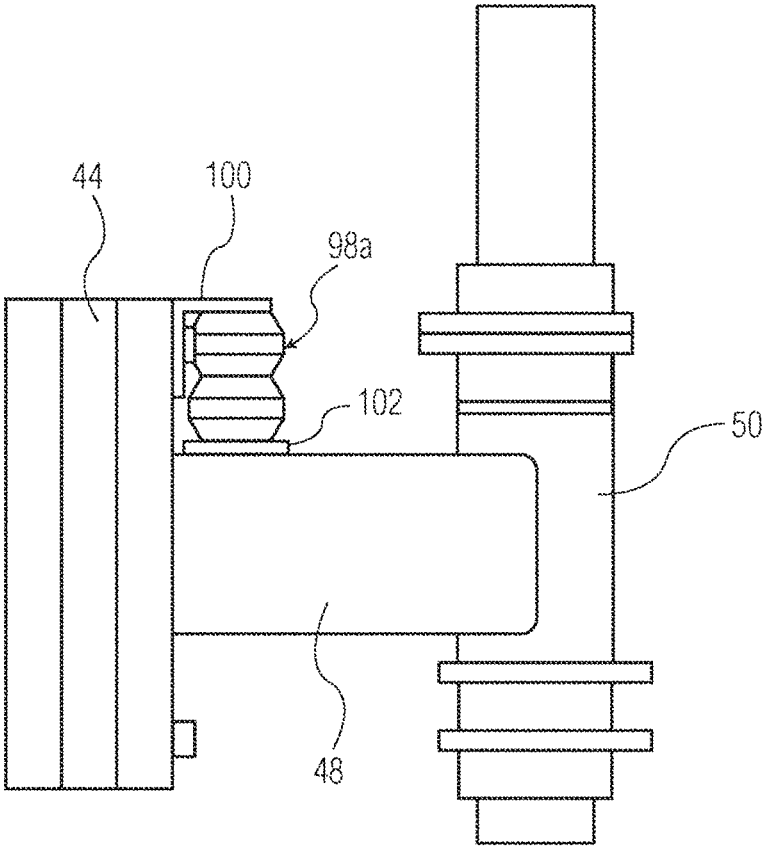
FIG. 11A is a side view.
Figure 11B:
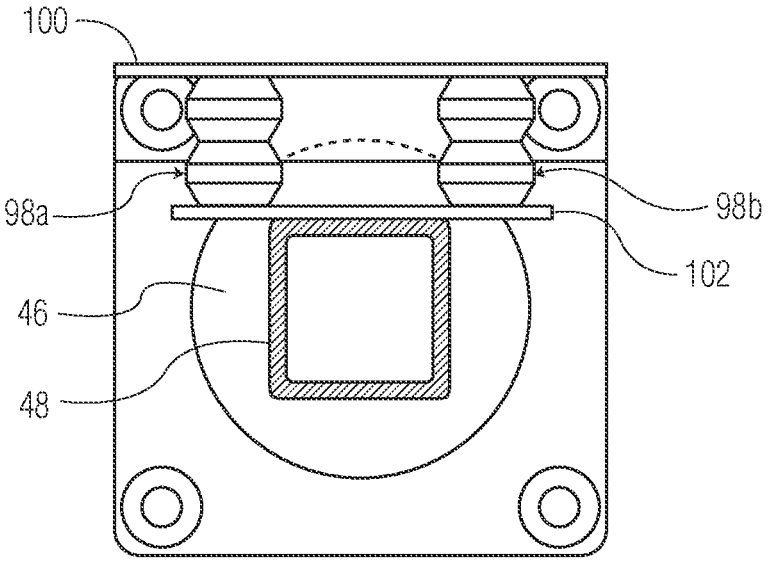
FIG. 11B is a front view, of the Pivot Box of FIG. 7 showing rubber springs which are used to maintain the snowplow blades in a horizontal configuration while the plow is in the raised position.

FIGS. 11A and 11B show details of a device for biasing the snowplow blades in the horizontal position. As noted above, the Pivot Box houses the rotating flange 46 which, in turn, holds an arm 48 that extends forward to the central plow hinge 50. The flange 46 can rotate from an approximate 10 o'clock position to the 2 o'clock position, as the plow encounters uneven surfaces ahead of the following vehicle. Rotation is limited by two Timbren® rubber springs 98A and 98B on either side of the arm 48 which are sandwiched between plate members 100 and 102 in front of the Pivot Box that extend laterally outward from the arm 48. The rubber springs keep the plow from rotating about the central axis C while the snowplow travels in the raised position.

There has thus been shown and described a novel snowplow apparatus for a motor vehicle which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Snowplow apparatus configured for removable attachment to the front of a motor vehicle, said vehicle having a grille and a vehicle frame with two spaced-apart points on the frame, positioned below the grille, for mounting said apparatus, said apparatus comprising, in combination:

(a) a connecting frame having a rearward mount with means for removable attachment to the motor vehicle at said spaced-apart points, and at least one forward mount with means for attachment to a snowplow, said connecting frame including a first hinge adjacent the rearward mount and a second hinge adjacent said forward mount, a pivot axis of said first hinge and a pivot axis of said second hinge extending substantially horizontally and substantially transverse to a central longitudinal axis of the vehicle;

(b) a snowplow, including at least one elongate snowplow blade, attached to said connecting frame at the forward mount thereof;

(c) a first powered mechanism for raising and lowering said snowplow about the pivot axis of said first hinge; and (d) a second powered mechanism for pivoting said snowplow about the pivot axis of said second hinge, thereby adjusting an orientation of the snowplow blade with respect to a road, when the blade is in a lowered, operative position;

wherein said connecting frame further comprises a third hinge having a pivot axis in substantial alignment with the central longitudinal axis of the vehicle, wherein said snowplow blade pivots about the pivot axis of said third hinge; and wherein said third hinge comprises (a) first, second and third plates mounted together in succession in face-to-face relationship, said second and third plates each having a central circular opening with the opening in the second plate larger than the opening in the third plate, (b) a stepped cylindrical flange member rotatable mounted within, and substantially filling, said circular openings of said second and third plates, and (c) a rod member having one end mounted coaxially on said flange member and coupled to rotate therewith, and having an opposite end coupled to and supporting said snowplow blade.

2. The apparatus recited in claim 1, wherein said connecting frame further comprises resilient means for biasing the snowplow blade about the pivot axis of said third hinge toward a substantially horizontal blade position.

3. The apparatus recited in claim 1, wherein the snowplow includes two elongate snowplow blades connected together, end to end, by means of a fourth hinge, a pivot axis of said fourth hinge extending substantially vertically and intersecting the pivot axis of the third hinge, one of said snowplow blades forming a left blade and the other forming a right blade with respect to the vehicle.

4. The apparatus recited in claim 3, further comprising a third powered mechanism for pivoting said two snowplow blades about said pivot axis of the fourth hinge.

5. The apparatus recited in claim 4, wherein said fourth powered mechanism pivots said two snowplow blades independently of each other.

6. The apparatus recited in claim 5, wherein said fourth powered mechanism comprises a left hydraulic piston having two ends, one end being coupled exert force against said vehicle and an opposite end being coupled to exert force against the left blade, and a right hydraulic piston having two ends, one end being coupled exert force against said vehicle and an opposite end being coupled to exert force against the right blade.

* * * * *